US005617902A

United States Patent [19]

Farley

[11] Patent Number: 5,617,902

[45] Date of Patent: Apr. 8, 1997

[54] WEAVING AND BONDING METHOD TO PREVENT WARP AND FILL DISTORTION

[75] Inventor: Gary L. Farley, Yorktown, Va.

[73] Assignee: The United States of America as represented by the Administrator of the National Aeronautics and Space Administration, Washington, D.C.

[21] Appl. No.: 495,253

[22] Filed: Jun. 26, 1995

[51] Int. Cl.[6] ..... D03D 13/00; D03D 23/00

[52] U.S. Cl. ..... 139/1 R; 139/DIG. 1; 139/384 R; 139/450; 139/116.1; 427/412; 28/169; 156/148; 156/181; 156/308.6; 156/290

[58] Field of Search ..... 427/412, 389.9; 264/257, 258; 28/166, 169; 156/148, 910, 181, 459, 149, 308.2, 308.6, 309.3, 283, 290, 82, 309.6; 428/245; 139/383 R, 384 R, DIG. 1, 116.1, 1 R, 450

[56] References Cited

U.S. PATENT DOCUMENTS

| | | | |
|---|---|---|---|
| 2,684,319 | 7/1954 | Arnold . | |
| 2,997,772 | 8/1961 | Etchison . | |
| 3,090,102 | 5/1963 | Jannarelli | 156/148 |
| 3,369,957 | 2/1968 | Caroselli et al. | 28/169 X |
| 3,639,199 | 2/1972 | Brandts et al. | 156/306 |
| 3,663,329 | 5/1972 | Rossmann . | |
| 3,769,131 | 10/1973 | Genson | 156/283 |
| 3,881,522 | 5/1975 | Lewis et al. | 139/420 R |
| 3,948,859 | 4/1976 | Sublett et al. | 156/332 |
| 4,116,743 | 9/1978 | Davis | 156/333 |
| 4,188,445 | 2/1980 | Hill | 428/246 |
| 4,276,333 | 6/1981 | Cobean | 156/305 |
| 4,370,784 | 2/1983 | Turnbull . | |
| 4,526,637 | 7/1985 | Long | 156/148 |
| 4,632,716 | 12/1986 | Smith | 156/148 |
| 4,713,283 | 12/1987 | Cogswell et al. . | |
| 4,891,264 | 1/1990 | Daimon et al. | 428/246 |
| 4,949,761 | 8/1990 | Fleury et al. | 139/384 R |
| 5,168,006 | 12/1992 | Inoguchi et al. . | |
| 5,212,010 | 5/1993 | Curzio et al. . | |
| 5,394,906 | 3/1995 | Farley | 139/384 R |
| 5,445,599 | 8/1995 | Edenbaum | 428/254 |

*Primary Examiner*—Andy Falik
*Attorney, Agent, or Firm*—Robin W. Edwards

[57] ABSTRACT

A method to prevent fiber distortion in textile materials employed in a modified weaving process. In a first embodiment, a tacifier in powder form is applied to the yarn and melted while on the fabric. Cool air is then supplied after the tacifier has melted to expedite the solidification of the tacifier. In a second embodiment, a solution form of a tacifier is used by dissolving the tacifier into a solvent that has a high evaporation rate. The solution is then sprayed onto the fabric or fill yarn as each fill yarn is inserted into a shed of the fabric. A third embodiment applies the tacifier in a liquid form that has not been dissolved in a solvent. That is, the tacifier is melted and is sprayed as a liquid onto the fabric or fill yarn as it is being extracted from a fill yarn spool prior to the fill yarn being inserted into the shed of the fabric. A fourth embodiment employs adhesive yarns contained as an integral part of the warp or fill yarn. Additional tacifier material is not required because a matrix is used as the tacifier. The matrix is then locally melted using heating elements on clamping bars or take-up rollers, is cooled, if necessary, and solidified.

19 Claims, 4 Drawing Sheets

WEAVING AND BONDING METHOD TO PREVENT WARP AND FILL DISTORTION

ORIGIN OF THE INVENTION

The invention described herein was made by an employee of the U.S. Government and may be used by or for the government for governmental purposes without the payment of royalties thereon or therefor.

BACKGROUND OF THE INVENTION

1. Field of the Invention

The present invention is directed to a method to prevent fiber distortion in textile materials. In particular, the present invention is directed to locally bonding warp and fill (weft) yarns of a fabric together to eliminate fabric skewing during a modified weaving process for weaving net-shaped tailored fabrics where fiber orientations may be non-orthogonal. These fabrics can be used to create optimally designed curved frames or other skeletal structures as well as skin type structures having compound curvatures.

2. Description of the Related Art

In general, fabric used in composite materials is very tightly woven together and does not readily skew due to a change in the spacing and orientation of fill yarns relative to warp yarns. Skewing can become a significant problem when a substantially unidirectional (uniweave) fabric having the compound fill yarns which are non-orthogonal, such as curved frames and other skeletal structures, is woven. This is described in U.S. patent application Ser. No. 017,205, filed Feb. 10, 1993, issued as U.S. Pat. No. 5,394,906, on Mar. 7, 1995, and incorporated by reference herein. Skewing significantly impacts the economical and structural performance of net shaped tailored fabrics and hence necessitated the development of this technology.

Weaving fabric with fill yarns at non-orthogonal angles to the warp yarns can cause the fabric to skew after the fabric is removed from the loom. When the fabric skews, a considerable amount of manual labor is required during a layup process to correctly reorient the fabric. Even after the fabric has been reoriented, the uniformity of the fibers may have been significantly compromised.

SUMMARY OF THE INVENTION

It is an object of the present invention to provide a method for making skew-resistant fabrics used in composite materials by weaving the warp and fill yarns in which the warp and fill yarns are bonded together at their points of contact.

Another object of the present invention is to provide a method for making skew-resistant fabrics by using a tacifier compatible with a reinforcement fiber (matrix or sizing) as the bonding agent.

Yet another object of the present invention is to provide a method for making skew-resistant fabrics by using a matrix as a bonding agent when weaving powder coated, comingled, and filament coated structural yarns.

Still a further object of the present invention is to provide a method for making skew-resistant fabrics by using a tacifier dissolved in a solvent and sprayed onto the fabric or fill yarn such that when the solvent evaporates, the tacifier is deposited onto the fabric bonding the warp and fill yarns together. Alternately, the tacifier can be put on a fill yarn while it is being inserted into the shed of the fabric (a "V" shaped region formed by lifting warp yarns).

Yet another object of the present invention is to provide a method for making skew-resistant fabrics by using a melted liquid tacifier sprayed onto a fabric or fill yarn. The tacifier solidifies and bonds the warp and fill yarns together.

Objects of the present invention are achieved by a method to prevent fiber distortion in woven materials comprising the steps of weaving fabric with warp and fill yarns concurrently with a weaving process for fabricating one of a straight, curved, planar and three-dimensional fabric that can be formed into a preform; depositing a tacifying material on the warp and fill yarns; and bonding the fabric together. The tacifier material can be deposited as a powder, in yarn form, sprayed as a solution onto the fabric or as a liquid. The tacifier material is then melted using heating elements in the tips of clamping bars or take-up rollers or by applying a hot gas. If a solvent based tacifier is applied to the warp and fill yarns, the solvent must be evaporated. Evaporating the solvent requires using only a room temperature air jet. The clamping bars or take-up rollers may also be used for fabric takeup. If clamping bars are employed, however, they may be used to ensure that the warp and fill yarns come into intimate contact, and not necessarily to be part of the takeup system. The clamping bars or take-up rollers may be heated or not heated. Including a heating element in the clamping bars or take-up rollers is optional depending on the type of tacifier employed. If take-up rollers are employed, they may be long continuous rollers or a row of many short rollers.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

DETAILED DESCRIPTION OF THE PREFERRED EMBODIMENTS

The present invention prevents the skewing of fabric during a weaving of curved frames and other skeletal structures in a modified weaving process, as set forth in U.S. Pat. No. 5,394,906. Warp and fill yarns are locally bonded by applying a tacifying material thereto. The warp and fill yarns are bonded together concurrently with the weaving process. The weaving process fabricates one of a straight, curved, planar or three-dimensional fabric. This prevents the fabric from skewing. The fabric can then be formed into a preform. The tacifying material can be a glue, adhesive, etc., that is compatible with a matrix, the matrix being the material that surrounds the warp and fill yarns and transfers load between the fibers of a cured composite material. The tacifying material is applied to the warp and fill yarns in a powder, yarn, solution or liquid (melted) form. The tacifier can also be applied as a constituent of a reinforcement fiber, i.e., a matrix or sizing (sizing being an adhesive-like material applied to the fibers to promote bonding of the matrix to the fibers). After the tacifier is solidified, the fabric becomes bonded together. The amount of bonding of the yarns of the fabric depends on the fiber orientation and geometry of the fabric as well as the yarn type and size and how the fabric is subsequently used. The amount of adhesive and/or the number of bond points is large enough to prevent or resist skewing, but not so large as to erabrittle the fabric, reduce its drape or in any way adversely influence the structural performance of the material.

The matrix can be, for example, a thermoset matrix or a thermoplastic matrix. A thermoset matrix is a polymer that when fully cross-linked becomes rigid. Additional heating of the thermoset matrix will not enable the structure to be reformed. Rather, it will just increase the glass transition temperature of the material, to a point. Thus, a thermoset material is "set" into a configuration once it is cured and cannot be reshaped. A thermoplastic matrix is a plastic that can be reshaped when reheated.

In the modified weaving process, fill yarns can be at non-orthogonal angles to warp yarns. The angle can vary according to the fabric. As embodied herein, the present invention employs a bonding or tacking technique to maintain the prescribed angle between the warp and fill yarns to prevent skewing. This is because when weaving at non-orthogonal angles, the fibers will try to become orthogonal due to a lower energy state required to maintain the orthogonal angles compared to the non-orthogonal angles.

Figure 1:
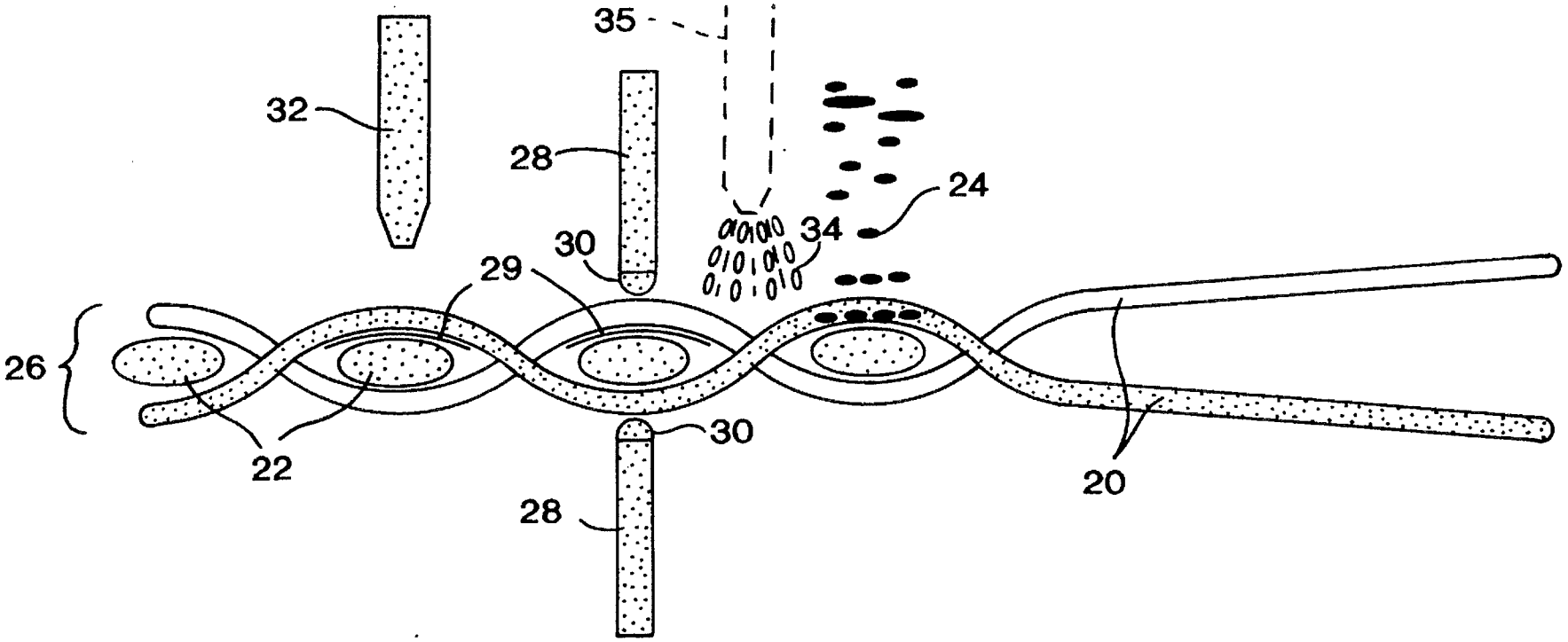
FIG. 1 is a cross-sectional view showing the tacifier applied in powder form to the warp yarns in accordance with a first preferred embodiment of the method of the present invention.

As shown in FIG. 1, according to a first embodiment of the method of the present invention, as the warp yarn 20 and fill yarn 22 are being woven, a tacifier powder 24 is deposited in the warp direction. The arrow in FIG. 1 shows the direction in which the process is performed. The fill yarns 22 (structural yarns) are weft yarns. The woven material (fabric) 26 is then passed through clamping bars 28 having heating elements 30 at their ends, respectively, to melt the tacifier while on the fabric 26. The melted tacifier 29 is then allowed to cool and solidify by blowing cool air from a cool air supply 32 onto the fabric 26 having the tacifier thereon. The cool air expedites the solidification of the tacifier. Although the heat used to melt the tacifier may come from heating elements 30 in the tips of the clamping bars 28, the tacifier could also be melted using a hot gas 34 from a hot air supply 35 as shown by the dotted lines in FIG. 1.

Figure 2:
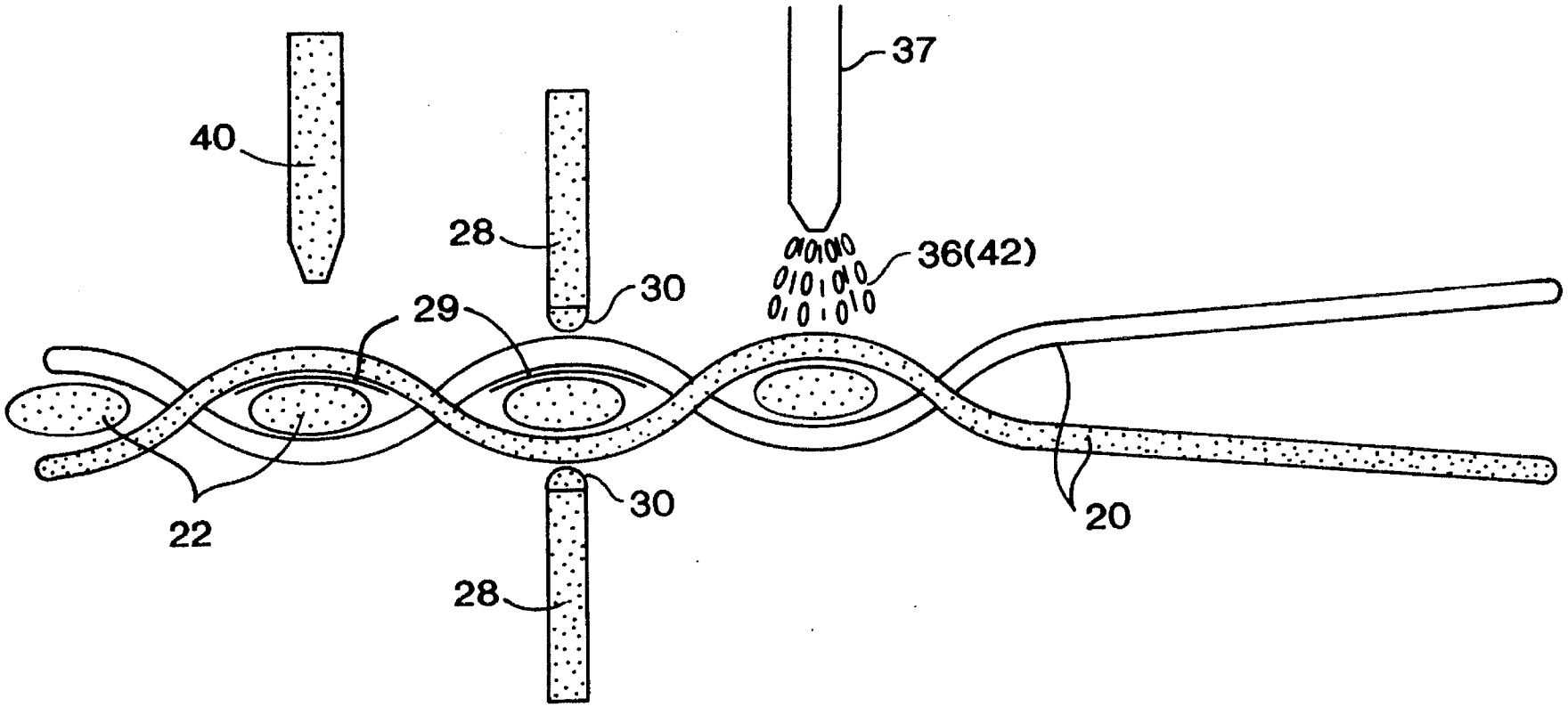
FIG. 2 is a cross-sectional view showing the tacifier dissolved in a solvent and sprayed onto the fabric or melted and sprayed in liquid form onto the fabric in accordance with a second and third embodiment of the method of the present invention.

As shown in FIG. 2, according to a second embodiment of the method of the present invention, a solution form of a tacifier 36 can also be used. Again, the arrow shows the direction in which the process is performed. The tacifier is dissolved in a solvent that has a high evaporation rate. The solution 36 is then sprayed from a nozzle 37 onto the fabric 26 or fill yarn 22 as each fill yarn is inserted. After the solution 36 is sprayed, the solvent evaporates leaving the tacifier on the fabric 26. Pressure can be applied to the fabric by means of conventional clamping bars 28 to further aid the bonding between the warp yarn 20 and fill yarn 22. Alternately, take-up rollers can be used. An air jet from an air supply 40 is then applied to increase the evaporation rate of the solvent. The particular solvent employed is a function of the tacifier, the desired weaving rate and the reactivity of the warp yarn 20 and fill yarn 22 to the solvent.

According to a third embodiment of the method of the present invention, a tacifier is applied in a liquid form 42 as shown in FIG. 2, rather than dissolved in a solvent as in the second embodiment. That is, the tacifier is melted and sprayed as a liquid onto the fabric 26 or fill yarn 22. The system is set up the same as shown in FIG. 2. The tacifier can be applied to the fill yarn 22 at any time during a fill insertion and beat up operation or thereafter. If the tacifier is applied directly to the fill yarn 22, the tacifier 42 is sprayed onto the fill yarn 22 as it is being extracted from the fill yarn spool prior to the fill yarn 22 being inserted into the shed of the fabric 26. The fill yarn 22 can be inserted by a variety of mechanisms including a shuttle, a rapier, water or air jets in high speed looms, or projectile devices if the yarn is very heavy. After the fill yarn 22 is beat up into the fell of the fabric 26, the fabric 26 is clamped together using clamping bars 28 (or takeup rollers 38 shown in FIG. 4) to ensure bonding between the warp yarn 20 and fill yarn 22. A cool air supply 40 is then sprayed onto the fabric 26 to expedite solidification of the liquid tacifier. An alternate approach is to embed heating elements 30 into the clamping bars 28 (or takeup rollers 38, shown in FIG. 4).

Figure 3:
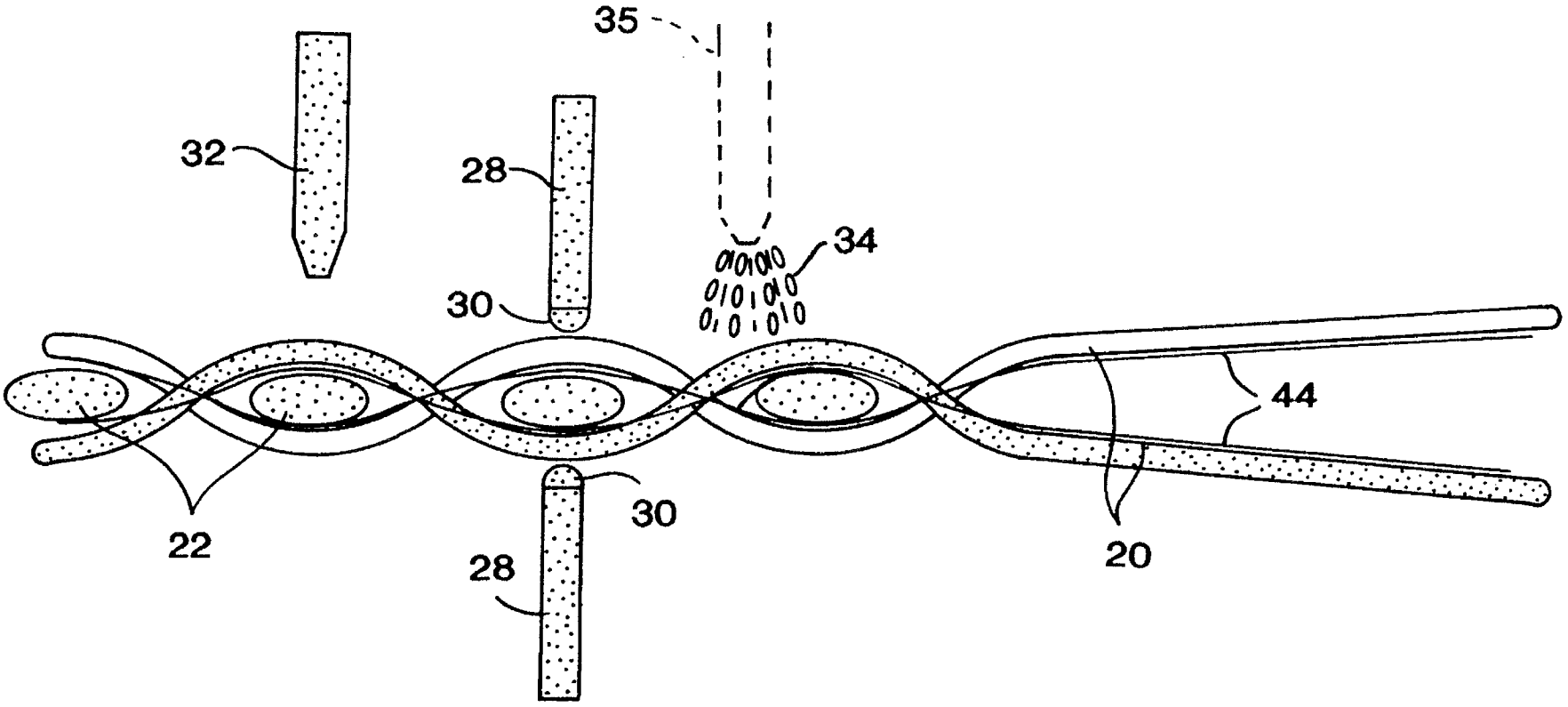
FIG. 3 is a cross-sectional view showing the warp yarns including an unmelted tacifier yarn in accordance with a fourth embodiment of the method of the present invention.

As shown in FIG. 3, according to a fourth embodiment of the method of the present invention, resin powder coated structural yarns 44 (adhesive yarns), comingled thermoplastic and structural yarns and coated yarns having a thermoplastic matrix are employed. The arrow shows the direction in which the process is performed. In all of these cases, the matrix, whether thermoset or thermoplastic, is contained as an integral part of the woven yarn. The adhesive yarns 44 can be run as separate independent yarns wrapped around the warp yarns 20, or a sleeve of material can encase the warp yarn 20.

The sleeve of material can be a thermoplastic composite material. For example, warp yarn 20 can be pulled through a die (not shown) where the thermoplastic composite material is coated on the external surface of the warp yarn 20. If a sleeve of adhesive material is placed around the warp yarn 20, this allows a predetermined (prescribed) amount of adhesive in the proximity of warp yarn 20 and fill yarn 22. Thus, when the adhesive is melted, it is localized to where bonding is required. After the fill yarn 22 is inserted into the shed and beat up into the fabric 26, clamping bars 28 containing heating elements 30 at their tips press against the fabric 26 to melt the tacifier as in the first embodiment. This bonds the warp yarn 20 and fill yarn 22 together. This same function can be achieved using heated takeup rollers 38 (shown in FIG. 4). The clamping bars 28 or heated take-up rollers 38 are then opened and the fabric is advanced. A hot gas 34 from a hot air supply 35 as shown in FIG. 1 can be used in place of the heating elements in the clamping bars or heated takeup rollers. Because the matrix (reinforcement fibers) is used as the tacifier, it is not necessary to apply any additional tacifier in powder, liquid or solvent form. The matrix is then cooled using a cool air supply 32 and solidified. Solidification of the matrix locks the warp yarn 20 and fill yarn 22 together preventing the fabric 26 from skewing. If a heating and cooling process is rapidly performed, then a thermoset matrix is not significantly advanced in cure. Using matrix coated yarns provides the advantage that it is only necessary to slightly warm a small portion of the matrix to soften the matrix. Once the yarn is beat up using a reed, adjacent yarns are locked together. That is, it is not necessary to melt all of the matrix. Further, depending on the operating speed of the system and type of matrix used, it may or may not be necessary to provide cooling for the matrix. The use of matrix coated yarns allows for reduction in fabrication cost of the structure.

Figure 4:
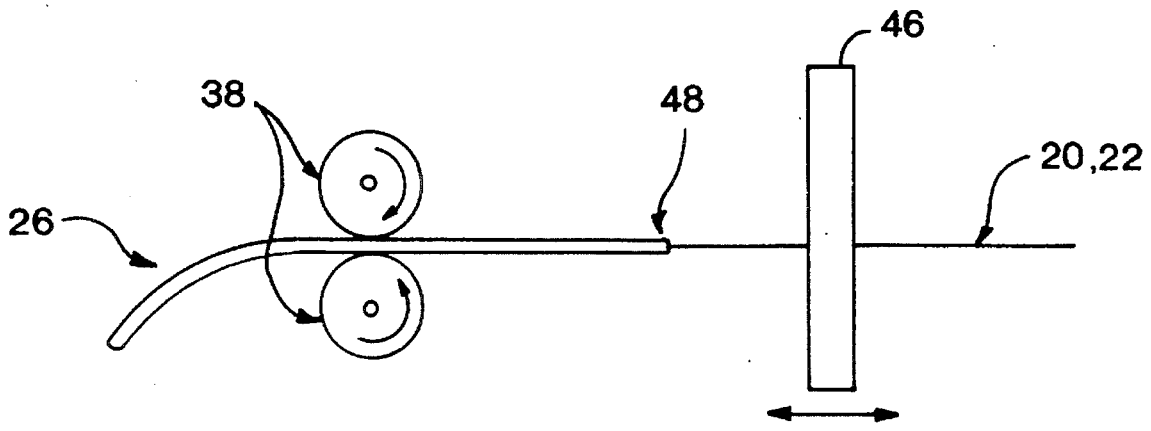
FIG. 4 is a cross-sectional view of a system employing take-up rollers rather than clamping bars for use in the embodiments of the method of the present invention.

FIG. 4 is a cross-sectional view of a system employing take-up rollers 38 rather than clamping bars 28 for use in the embodiments of the method of the present invention as described above. As mentioned above, the take-up rollers 38 can be used interchangeably with the clamping bars 28 in any of the above embodiments. Additionally, it shows a reed 46 which pushes the warp yarn 20 and fill yarn 22 together to form a fabric 26. The reed 46 moves in the direction shown by the arrows. Reference numeral 48 shows the point at which the fabric 26 is formed.

The above-mentioned methods of the present invention can be applied to other textile processes such as braiding or knitting where a preform geometry and fiber architecture produces a fabric that distorts.

As set forth above, the preferred embodiments of the present invention include local bonding of warp and fill yarns of a modified weaving process by a bonding agent. The bonding agent can be a tacifier or a matrix. These features provide the advantages that skewing of the fabric is prevented and cost of fabrication of the woven structure is decreased.

The foregoing is considered as illustrative only of the principles of the invention. Further, since numerous modifications and changes will readily occur to those skilled in the art, it is not desired to limit the invention to the exact construction and applications shown and described, and accordingly, all suitable modifications and equivalents may be resorted to, falling within the scope of the invention and the appended claims and their equivalents.

We claim:

1. A method to prevent fiber and fabric distortion in woven materials when weaving fill yarns at a non-orthogonal angle to warp yarns, comprising the steps of:

(a) weaving fabric with warp and fill yarns concurrently with a weaving process for fabricating one of a straight, curved, planer and three-dimensional fabric, the fill yarns at a non-orthogonal angle to the warp yarns;

(b) depositing a tacifying material on the warp and fill yarns; and (c) bonding the warp and fill yarns together.

2. A method according to claim 1, wherein in said step (b) the tacifier material is deposited as a powder and step (c) further comprises the substeps of:

(i) melting the tacifier material while on the warp and fill yarns; and (ii) supplying cool air to solidify the tacifying material.

3. A method according to claim 2, wherein in said substep (c) (i) the tacifier material is melted by providing heating elements in the tips of clamping bars.

4. A method according to claim 2, wherein in said substep (c) (i) the tacifier material is melted by providing heating elements in take-up rollers.

5. A method according to claim 2, wherein in said substep (c) (i) the tacifier material is melted by applying a hot gas.

6. A method according to claim 1, wherein in said step (b) the tacifier material is deposited in a yarn form and step (c) further comprises the substeps of:

(i) melting the tacifier material; and (ii) supplying cool air to solidify the tacifying material.

7. A method according to claim 6, wherein in said substep (c) (i) the tacifier material is melted by providing heating elements in the tips of clamping bars.

8. A method according to claim 6, wherein said substep (c) (i) the tacifier material is melted by providing heating elements in take-up rollers.

9. A method according to claim 6, wherein in said substep (c) (i) the tacifier material is melted by applying a hot gas.

10. A method according to claim 1, wherein in said step (b) the tacifier material is deposited in a solution form by spraying the solution onto the fabric and step (c) further comprises the substep (i) of applying pressure to the fabric to bond the warp and fill yarns.

11. A method according to claim 10, wherein step (c) further comprises the substep (ii) of supplying air to increase evaporation of the solution.

12. A method according to claim 1, wherein in said step (b) the tacifier material is in liquid form and step (c) further comprises the substeps of:

(i) melting the tacifier material; and (ii) spraying the melted tacifier material, as a liquid, onto the fill yarn after being extracted from a fill yarn spool prior to the fill yarn being inserted into a shed of the fabric.

13. A method according to claim 12, wherein said step (c) further comprises the substeps of:

(iii) clamping the fabric to bond the warp and fill yarns; and (iv) supplying cool air to the fabric to expedite evaporation of the liquid.

14. A method to prevent fiber and fabric distortion in woven materials when weaving fill yarns at a non-orthogonal angle to warp yarns, comprising:

(a) supplying yarn containing adhesive for forming a fabric;

(b) inserting fill yarn into a shed of the fabric;

(c) beating the fill yarn into the fabric such that the fill yarn is non-orthogonal to the warp yarn;

(d) melting the adhesive in the yarn;

(e) advancing the fabric; and (f) supplying cool air to the fabric to solidify the adhesive.

15. A method according to claim 14, wherein said step (c) comprises the substeps of:

(i) pulling the fabric through heated clamping bars; and (ii) opening the clamping bars.

16. A method according to claim 14, wherein said step (c) comprises the substeps of:

(i) pulling the fabric through heated take-up rollers; and (ii) opening the take-up rollers.

17. A method according to claim 14, wherein in said step (a) the yarn containing adhesive is selected from a group consisting of one of resin powder coated structural yarns, comingled thermoplastic and structural yarns, and coated yarns having a thermoplastic matrix.

18. A method to prevent fiber end fabric distortion in woven materials, comprising the steps of:

(a) weaving fabric with warp and fill yams concurrently with e weaving process for fabricating one of a straight, curved, planar and three-dimensional fabric;

(b) depositing a tacifying material on the warp and fill yarns to bond them together, wherein the tacifier material is in liquid form;

(c) melting the tacifier material; and (d) said depositing step including spraying the melted tacifier material onto the fill yarn after being extracted from a fill yarn spool prior to the fill yarn being inserted into a shed of the fabric.

19. A method according to claim 18, further comprising the steps of:

(e) clamping the fabric to effect said bonding of the warp and fill yarns; and (f) supplying cool air to the fabric to expedite evaporation of the liquid.

* * * * *